US006223980B1

(12) United States Patent
Guillin

(10) Patent No.: US 6,223,980 B1
(45) Date of Patent: May 1, 2001

(54) PACKAGING BOX COMPRISING A CARDBOARD BOTTOM AND A TRANSPARENT LID

(75) Inventor: Francois Guillin, Mouthier Hautepierre (FR)

(73) Assignee: Groupe Guillin, Ornans (FR)

( * ) Notice: Subject to any disclaimer, the term of this patent is extended or adjusted under 35 U.S.C. 154(b) by 0 days.

(21) Appl. No.: 09/297,279

(22) PCT Filed: Oct. 29, 1997

(86) PCT No.: PCT/FR97/01939

§ 371 Date: May 24, 1999

§ 102(e) Date: May 24, 1999

(87) PCT Pub. No.: WO98/18685

PCT Pub. Date: May 7, 1998

(30) Foreign Application Priority Data

Oct. 30, 1996 (FR) ..... 96 13250

(51) Int. Cl.[7] ..... B65D 5/12; B65D 25/24

(52) U.S. Cl. ..... 229/122.21; 229/122.22; 229/162; 220/4.21; 220/62; 220/602; 220/611; 220/617; 220/655; 220/DIG. 25

(58) Field of Search ..... 229/122.21, 122.22, 229/122, 162, 125.015, 125.17, 125.19, 125.28, 125.09; 220/4.21, 62, 602, 611, 615, 617, 618, 662, 665, 674, 675, 676, 682, 690, DIG. 25

(56) References Cited

U.S. PATENT DOCUMENTS 1,069,834 * 8/1913 White ..... 229/122.21
2,493,671 * 1/1950 Horning ..... 229/125.09 X
2,597,848 * 5/1952 Reeser ..... 229/117.16
2,623,685 * 12/1952 Hill ..... 229/125.17
2,990,998 7/1961 Barclay .
3,910,483 * 10/1975 Ritter ..... 229/125.19
3,935,943 * 2/1976 Meyer et al. ..... 229/125.015
4,380,447 4/1983 VanderLugt, Jr. .
5,699,959 * 12/1997 Huspeka et al. ..... 229/125.28
5,975,412 * 11/1999 Guillin ..... 229/122.22

FOREIGN PATENT DOCUMENTS 572 970 11/1958 (BE) .
1 147 276 11/1957 (FR) .
1 439 221 4/1966 (FR) .

* cited by examiner

*Primary Examiner*—Allan N. Shoap
*Assistant Examiner*—Tri M. Mai
(74) *Attorney, Agent, or Firm*—Young & Thompson

(57) ABSTRACT

A packaging box comprising a cardboard bottom and a transparent lid removably mounted on the opening of the bottom. The lid comprises a convex portion facing inside the box and cooperating with the opening of the bottom and at least two flaps articulating on opposite edges of the lid. Each overlapping at least partly a side face of the bottom. The flaps each comprise at least locking elements cooperating with complementary locking elements provided in one side face of the bottom or with complementary locking elements born by the other flap auxiliary flaps articulated on the other edges of the lid. The invention is applicable to the packaging of food products.

5 Claims, 6 Drawing Sheets

PACKAGING BOX COMPRISING A CARDBOARD BOTTOM AND A TRANSPARENT LID

CROSS REFERENCE TO RELATED APPLICATION

This application is the 35 USC §371 national stage of International application PCT/FR97/01939, filed on Oct. 29, 1997 which designated the United States of America.

FIELD OF THE INVENTION

The present invention relates to a packing box for products, in particular food products such as pastries.

BACKGROUND OF THE INVENTION

Packaging boxes conventionally used in the food trade are generally made of a cardboard blank, cut out, bent and cemented. Such boxes conventionally are not usable in industry and for the distribution of foodstuffs because of their cost of production and filling. Moreover, this type of package does not permit the enclosed product to be seen.

There have been developed boxes that are entirely of transparent or translucent material, permitting overall direct viewing of the contained product.

However, such boxes are not suitable for high-class contents such as for example pastries, because of their poor and relatively cheap appearance.

It is thus preferred to use boxes whose bottom is of cardboard and on which has been placed a transparent film or cover arranged to fit onto the bottom.

So as to obtain viewing of the contents, the cover can comprise a window on top closed by a transparent or translucent film. The cover can also be made entirely of transparent or translucent plastic material. However, in this latter case, the production of such covers and their emplacement are not easy. Moreover, there is not always obtained a locked closure of said cover on the bottom, the cover being simply placed over the bottom.

There has been proposed, in Belgian patent BE-A-572 970, a box constituted of a bottom on which is disposed and locked a cover having a shape corresponding to the opening of the bottom of the box and which comprises two flaps articulated on opposite corners of the cover. These flaps can cover totally the side faces of the bottom and thus have respectively an edge of their own disposed below the bottom, the bottom thus having on its side surfaces retaining plates whose lower portion extends below the bottom so as each to constitute a retaining element in which can be fixed the flexible edge of each flap of the cover provided with a groove adjacent of the bend between the flap and the edge.

According to another embodiment, in the absence of a retaining plate, the edge is bent into V-shape and is disposed below the bottom or else a retaining plate is provided along all the lengths of the lateral surface to serve as an abutment to the free end of the edge bent in a V. The articulated flaps can also partially cover the lateral surfaces of the bottom and more precisely the upper edge of said lateral surfaces. These flaps thus have an edge co-acting with an edge of the opening of the bottom by the horizontally projecting opening of the bottom provided at the upper end of the lateral surfaces.

In this type of box, it is thus necessary, to obtain good closure, to provide locking means for the flaps carried by the bottom which are always projecting from one lateral surface either at its upper end or at its lower end. These locking means provided on a corner of a lateral surface of the bottom are not always simple to make.

SUMMARY OF THE INVENTION

So as to overcome these drawbacks, there is proposed a packaging box whose cover of transparent or translucent plastic material is easily produced and whose closure is simple and easy because of the simple and easy emplacement of the cover on the box, the closure being adapted also moreover to be locked.

To this end, the invention has for its object a packaging box of the type comprising an open cardboard bottom of parallelepipedal shape and a transparent or translucent cover mounted removably on the opening of said bottom, characterized in that the cover comprises an embossment turned inwardly of the box and co-acting with the opening of the bottom as well as at least two flaps articulated on opposite edges of the cover, each covering at least partially a lateral surface of said bottom, said flaps moreover each comprising at least one locking means co-acting with a complementary locking means provided in a side surface of the bottom or with complementary locking means carried by the other flap or auxiliary flaps articulated on other edges of the cover.

Thus, upon emplacement of the cover on the bottom, there is ensured a closing of the box by the co-action of the locking means carried by the flaps with the complementary locking means provided on the bottom and/or on the other flaps of the cover.

The bottom is preferably made of cardboard in the conventional way, and it can be of the "automatic" type, that is, re-bendable.

The cover is preferably constituted by thermo-forming a plastic material, elastically deformable, transparent or translucent. It is present in the form of a parallelepipedal corresponding to the opening of the bottom.

Thus, according to a first embodiment, the cover comprises a protrusion turned inwardly of the box when the cover is emplaced on the bottom and at least two opposite flaps provided each with locking means co-acting with a complementary locking means provided in each lateral surface of the base that the flaps cover at least partially.

According to a modification, the cover preferably comprises two opposite flaps covering respectively entirely a lateral surface of the bottom, each flap having at its lateral ends, end tongues articulated about the corners of the bottom, each end tongue partially covering the adjacent lateral surface and each tongue having moreover a locking means co-acting with a complementary locking means provided on said adjacent lateral surface of the bottom.

Preferably, the locking means are of the tongue/slot type, known per se, and, in the case of the modified embodiment, they are provided respectively on the end tongues of the flaps of the cover and on the ends of the side surfaces of the bottom which are not covered by the flaps of the cover.

This modification permits providing recesses in the side surfaces of the bottom covered by the flaps of the cover so as to offer greater visibility of the product contents, said flaps being adapted to have embossments engaging in said recesses. In this manner there is assured good emplacement of the cover on the bottom.

In this embodiment, the closing of the box is obtained by the emplacement of the cover and the co-action of the locking means of said cover and of the bottom. The locking of the closure is obtained simultaneously to the closure itself by cooperation of the locking means of the flaps and of those of the bottom.

According to a second embodiment of the invention, the cover comprises at least two opposite flaps, each of the flaps being provided with locking means co-acting with a complementary locking means provided on the other flap or on an auxiliary flap of the cover so as to ensure closure of the cover on the bottom.

Thus, the emplacement of the abutment of the cover on the opening of the bottom permits good positioning and the closure is obtained simply by assembling the cover on the bottom by co-action of the locking means of the flaps which extend along lateral surfaces of the bottom. There is accordingly no need to encase the cover along the lateral walls of the bottom, which greatly facilitates closure of the box.

In this embodiment, each of the flaps comprises preferably an embossment as such to engage in a recess provided on the surface of the bottom covered by said flap so as to obtain among other things a locking of the closure of the box by engagement of said embossments in the windows of the bottom.

According to a first modification of this embodiment, the two flaps of the cover have, at their side ends, lateral prolongations articulated on the edges of the bottom, the two lateral prolongations of the first flap of the cover partially covering the adjacent surfaces and the two lateral prolongations of the second flap of the cover also covering partially the same surfaces, said lateral prolongations being arranged to cover said surfaces, one of the prolongations comprising a locking means co-acting with a complementary locking means provided on the other said prolongation.

Thus, upon locking the lateral prolongations, the cover is closed on the bottom, the embossments of the flaps being moreover engaged and maintained in their recesses in the surfaces of the bottom so as to lock the box closed.

The lateral prolongations can be shaped so as to form, upon locking, an embossment adapted to engage in an opening provided in the lateral side of the bottom that they cover. Thus, there can be used a bottom having an opening on each side surface.

In this manner, the co-action of the locking means of a flap with the complementary locking means of the other flap permit easy closure of the box, locking of this closure being obtained by the engagement of the embossments of the flaps in the windows of the bottom.

According to a second modification of this embodiment, one of the flaps of the cover is provided at its side ends with two lateral prolongations pivoted on the edges of the bottom and adapted to cover totally the two adjacent lateral surfaces, each side prolongation comprising an end tongue articulated about an edge of the bottom and partially covering the second flap of the cover, each end tongue having a locking means co-acting with a complementary locking means provided on the second flap of the cover.

In this case as well, the bottom can comprise an opening on each lateral surface, each lateral prolongation being adapted to have a complementary protrusion thus ensuring the locking of the closure of the box.

According to a third modification of this embodiment, the cover has four flaps articulated on the edges of the cover, two opposite flaps having at their lateral ends an end tongue articulated on an edge and partially covering the adjacent auxiliary flaps, said end tongues having respectively locking means and the two adjacent auxiliary flaps having at their lateral ends a complementary locking means.

Preferably, in this embodiment, the locking means carried by a flap are tongues, the complementary locking means carried by the other flap or an auxiliary flap being slots.

It can also be provided that each flap of the cover has an end tongue provided with locking means co-acting with a complementary locking means provided at the end of the adjacent flap which covers the end tongue and has a complementary locking means at its other end adapted to co-act with a locking means carried by the end tongue of the other adjacent flap.

BRIEF DESCRIPTION OF THE DRAWINGS

The invention will now be described in greater detail with the help of examples of the invention showing schematically a box before assembly of the cover on the bottom, with reference to the accompanying drawings, in which.

DESCRIPTION OF THE PREFERRED EMBODIMENTS

Figure 1:
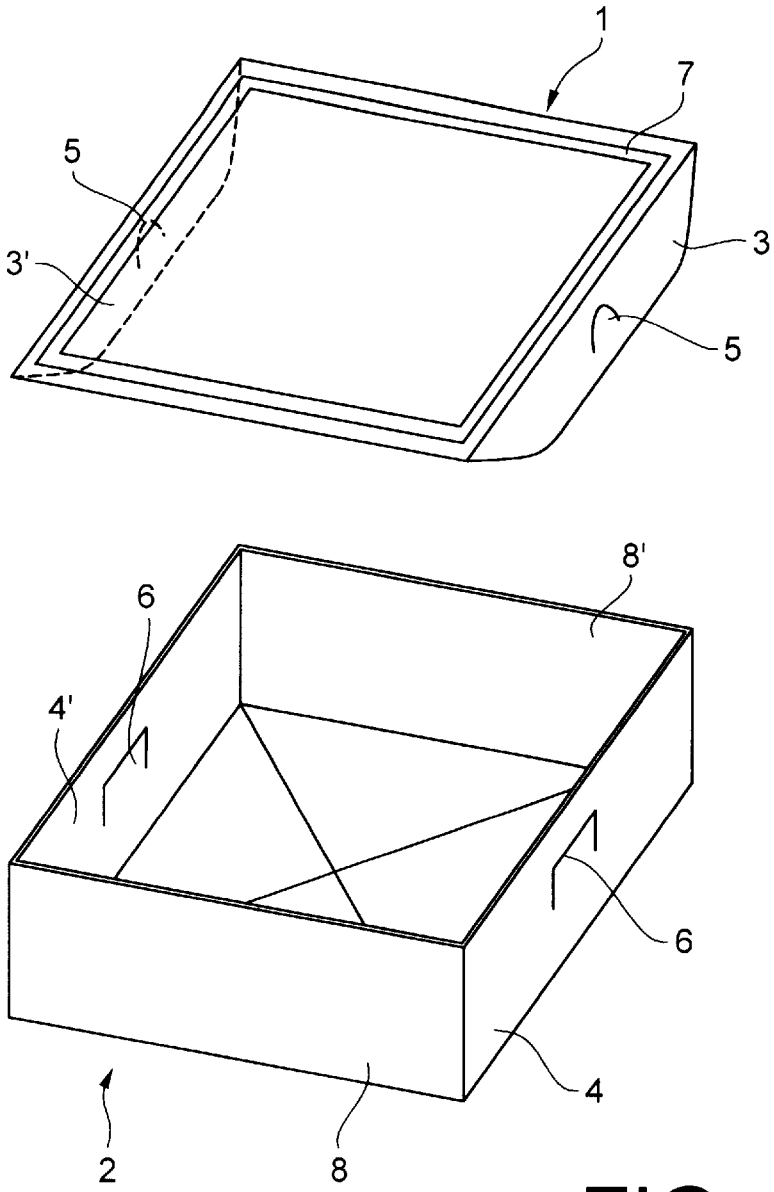
FIG. 1 is a perspective view of a box according to a first embodiment of the invention.
Figure 1A:
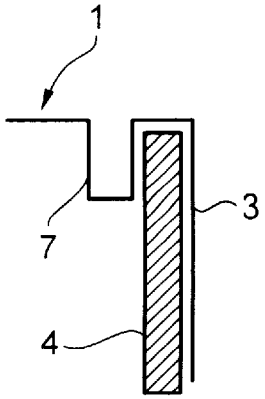
FIG. 1*a* shows schematically in cross section the embossment turned inwardly of the box and co-acting with the opening of the bottom.

As can be seen in FIG. 1, a box according to the invention comprises a cover 1 and a bottom 2.

The bottom 2 of cardboard has an open parallelepipedal shape and comprises four side surfaces 4, 4' and 8, 8'.

The cover 1 is made by thermo-forming an elastically deformable plastic material and is prolonged by two flaps 3, 3' which, when the cover 1 is emplaced on the bottom 2, cover respectively partially the two opposite surfaces 4, 4' of the bottom 2. Each flap 3, 3' comprises a tongue 5 lockable in a slot 6 provided at the same position on each surface 4, 4'.

On the external surface of the cover 1 is formed a rib forming an embossment 7 which constitutes an abutment member against the periphery of the edges of the opening of the bottom 2, thereby ensuring good emplacement of the cover 1 on the bottom 2.

So as to close the box, it suffices to emplace the cover 1 and to introduce the tongues 5 into the slot 6 so as to lock the closure.

Figure 2:
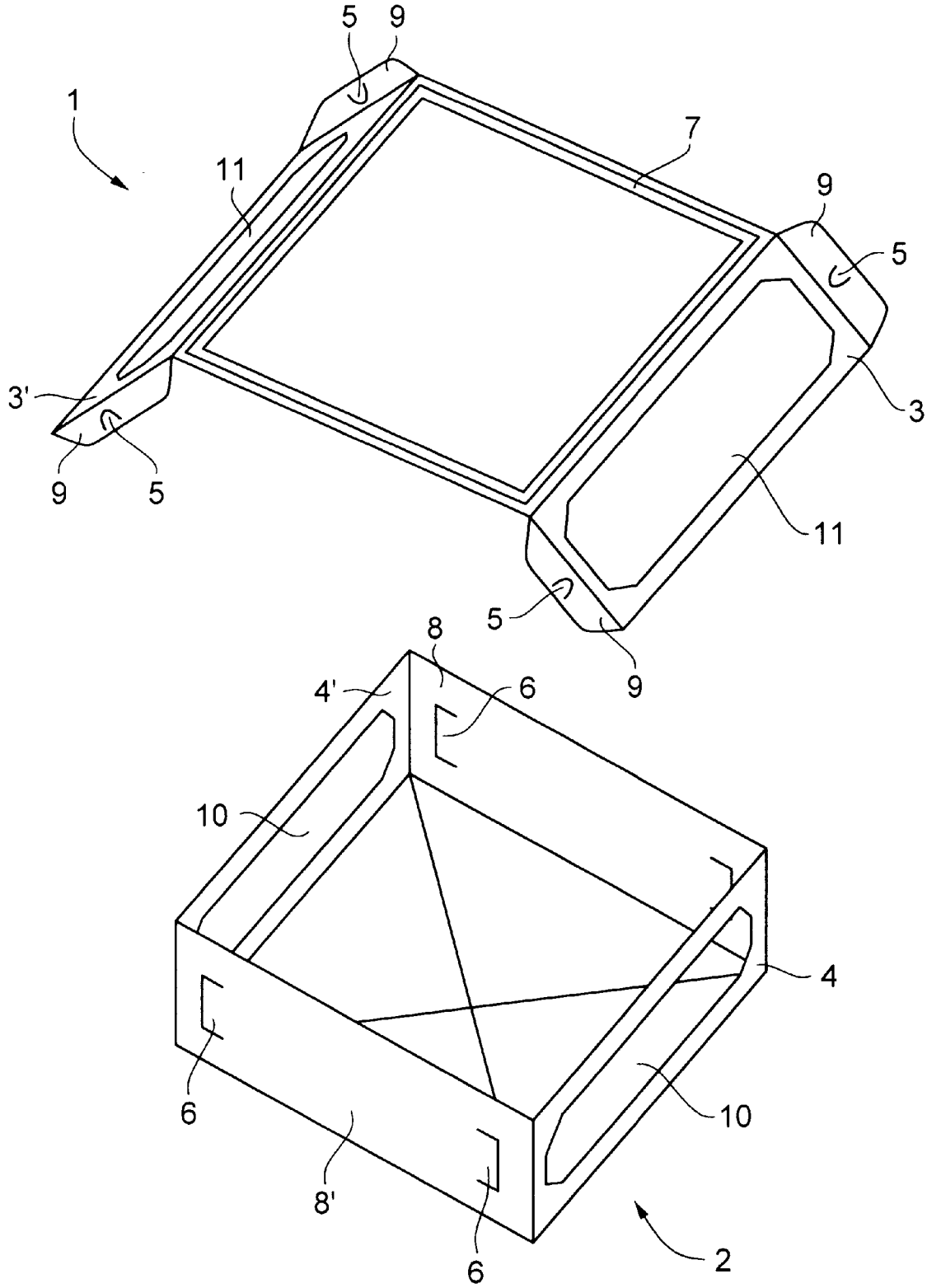
FIG. 2 is a perspective view of a box according to a modification of the first embodiment of the invention.
Figure 2A:
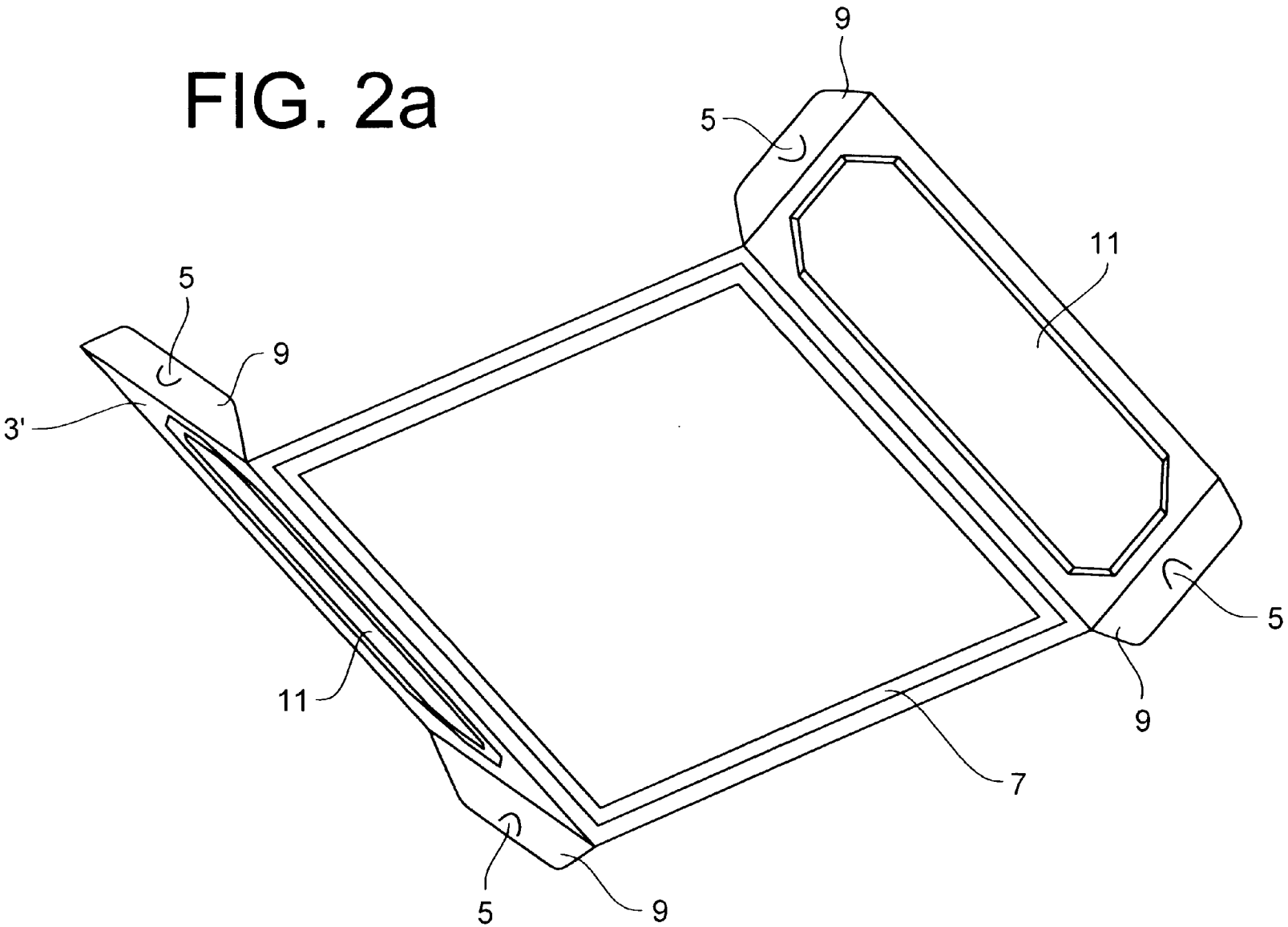
FIG. 2*a* shows the cover upside down with each flap having an embossment for engagement with a respective recess on the lateral surface of the bottom.

In FIG. 2, the flaps 3, 3' have dimensions suitable to cover totally the surfaces 4 and 4' of the bottom 2. Each flap 3, 3' comprises two end tongues 9. Upon emplacement of the cover 1 on the bottom 2, the flaps 3 and 3' cover the surfaces 4 and 4' and the end tongues 9 articulated on the edges of the bottom 2 partially cover the two adjacent surfaces 8 and 8' of the bottom 2. Each end tongue 9 is provided with a tongue 5 co-acting with a slot 6 provided at the same place at each end of the surfaces 8 and 8' of the bottom 2.

Preferably, the openings 10 in the surfaces 4 and 4' of the bottom 2, the flaps 3 and 3' being provided with an embossment 11 corresponding to said openings 10 such that, when the flap 3 or 3' covers the surface 4 or 4', the embossment 11 engages in the opening 10.

Figure 3:
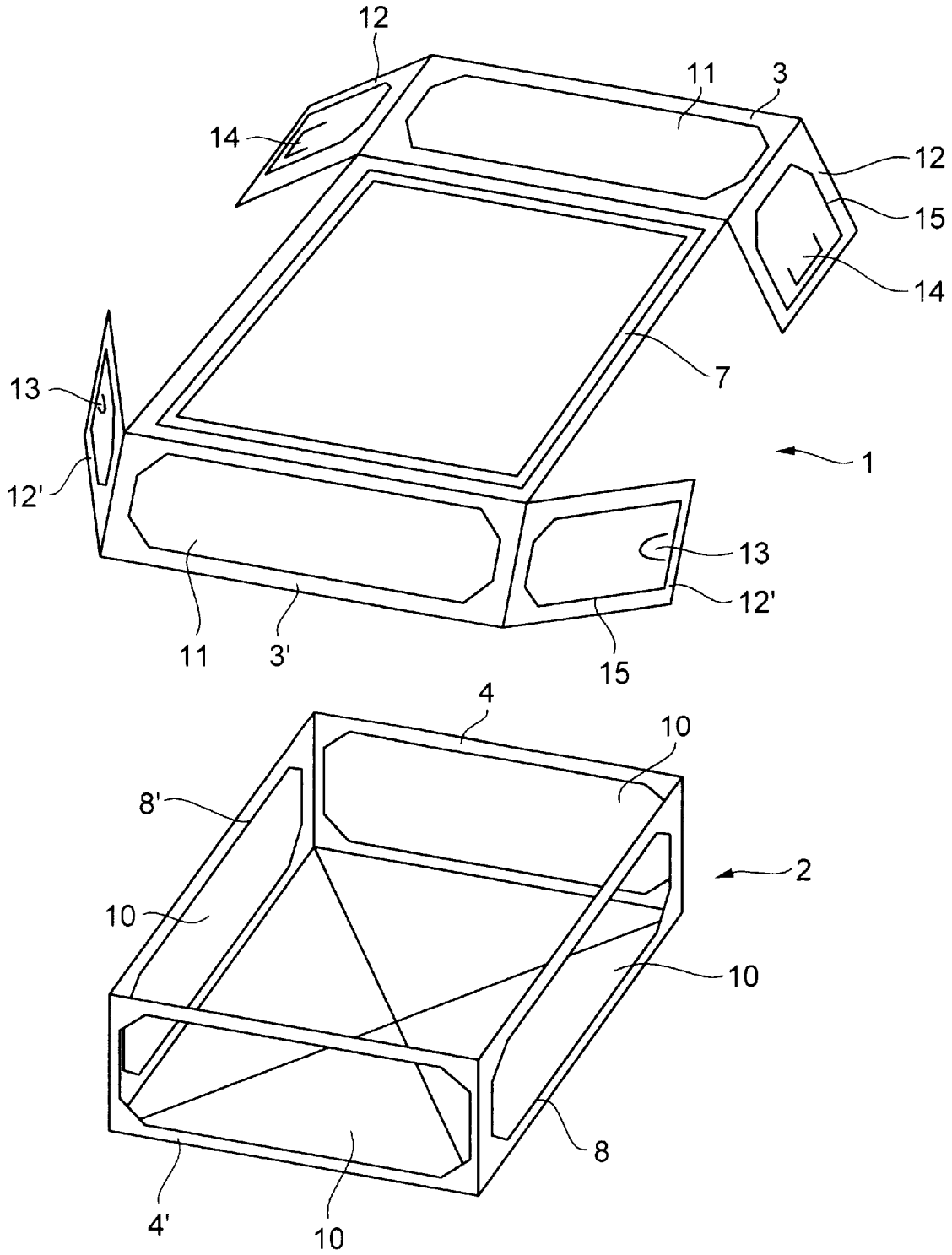
FIG. 3 is a perspective view of a box according to a first modification of a second embodiment of the invention.
Figure 4:
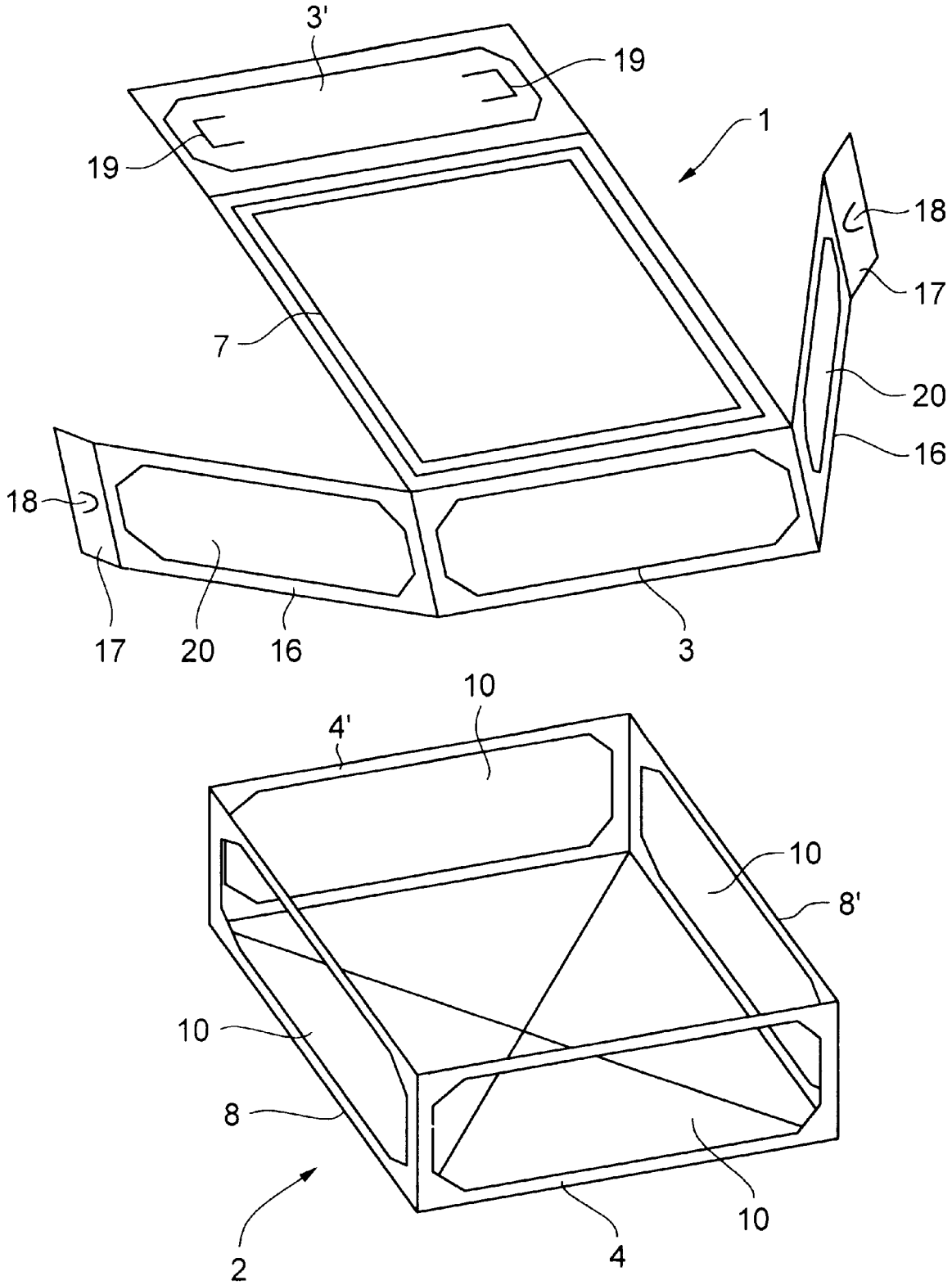
FIG. 4 is a perspective view of a box according to a second modification of the second embodiment of the invention.
Figure 5:
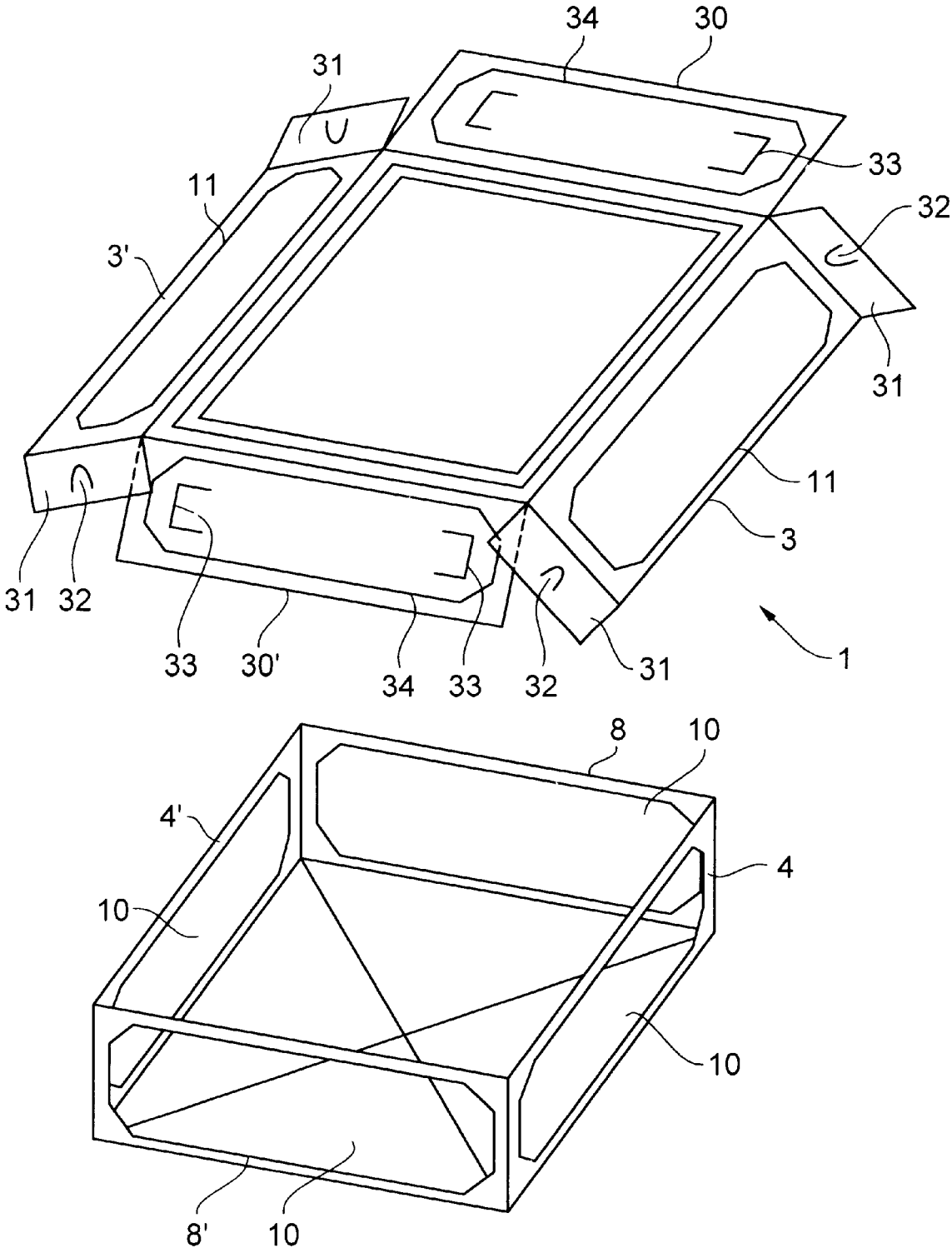
FIG. 5 is a perspective view of a box according to a third modification of the second embodiment of the invention.

FIGS. 3, 4 and 5 show the second embodiment of the invention.

In FIG. 3, the flaps 3 and 3' are provided with embossments 11 adapted to engage in openings 10 provided in the surfaces 4, 4' of the bottom 2 that they cover.

The flaps 3, 3' are moreover provided, at their side ends, with prolongations 12, 12'. Thus, although the flaps 3, 3' cover the surfaces 4, 4', the lateral prolongations 12 and 12' of the flaps 3 and 3' partially cover the two adjacent surfaces 8 and 8' of the bottom 2. A lateral prolongation 12 and a lateral prolongation 12' extending along a same surface 8 or 8' of the bottom 2 are so dimensioned as to overlap, one comprising a tongue 13 and the other a slot 14.

Upon locking the lateral prolongations 12 and 12', the embossments 11 of the flaps 3, 3' are engaged in the openings 10 of the surfaces 4, 4'. Thus, the cover 1 is retained on the bottom 2 by means of the embossments 11 engaged in the openings 10, the closure of the box obtained by the co-action of the locking means of the flaps 3, 3' is thus perfectly locked.

In this embodiment, it is possible to provide a bottom 2 of which all the surfaces 4, 4', 8 and 8' are provided with openings 10, the lateral prolongations 12, 12' being shaped so as to form, upon their locking on the surfaces 8 and 8', an embossment 15 engaging in the opening 10 of said surfaces 8 and 8'.

According to the modification of the second embodiment shown in FIG. 4, only the flap 3 is provided with lateral prolongations 16 adapted to cover the adjacent surfaces 8 and 8'. Each lateral prolongation 16 comprises at its longitudinal end, an end tongue 17 adapted partially to cover the end of the adjacent flap 3'. Each end tongue 17 comprises a tongue 18 co-acting with a slot 19 provided at the same position on the flap 3'.

The lateral prolongations 16 can also comprise an embossment 20 adapted to engage in an opening 10 provided on each surface 8, 8' of the bottom 2 which thus comprises four openings 10.

In FIG. 5, the cover 1 comprises four flaps 3, 3', 30, 30', the two opposite flaps 3, 3' comprising end tongues 31 partially covering the ends of the two auxiliary flaps 30, 30' respectively articulated on the edges of the cover which do not comprise flaps 3, 3'. Each end tongue 31 has a tongue 32 co-acting with a slot 33 provided at each end of the adjacent flaps 30, 30'.

Preferably, the locking of the closure of the box is ensured by engagement of the embossments 11 provided on each flap 3, 3' and the embossments 34 provided on the flaps 30 and 30' in openings 10 provided on each lateral surface 4, 4', 8 and 8' of the bottom 2.

A box according to the invention therefore offers the advantage of being adapted to be easily closed, the cover being adapted to be locked on the bottom, of being also equally easy to open, the means being reversible, of being simple in construction, and easy to store before use, the cover in particular being stackable and the bottom being adapted to be folded.

What is claimed is:

1. Packaging box comprising:

an open cardboard bottom having a parallelpipedal shape and a plurality of lateral surfaces;

a transparent cover removably mounted on the opening of the bottom;

said cover comprising an embossment turned inwardly of the box for co-acting with the opening of the bottom, and at least two flaps articulated on opposite edges of the cover; each flap totally covering one of the lateral surfaces of the bottom; each flap further comprising at least one locking means for co-acting with one of a complementary locking means provided in a lateral surface of the bottom and a complementary locking means carried by one of the other flaps or auxiliary flaps articulated on other edges of the cover; each flap comprising end tongues articulated on edges of the bottom and partially covering the adjacent lateral surfaces; one of said locking means being arranged on each end tongue for co-acting with one of the complementary locking means carried by said adjacent lateral surface.

2. Box according to claim 1, wherein the bottom is foldable.

3. Box according to claim 1, wherein the cover is constituted by thermo-forming a transparent elastically deformable plastic material and is stackable.

4. Box according to claim 1, wherein the locking means are constituted by tongues, and the complementary locking means carried by the bottom are slots.

5. Box according to claim 1, wherein the flaps of the cover have embossments for engaging openings provided in lateral surfaces of the bottom which they cover.

* * * * *